US009041608B2

(12) United States Patent
Hong et al.

(10) Patent No.: US 9,041,608 B2
(45) Date of Patent: May 26, 2015

(54) PORTABLE ELECTRONIC DEVICE AND HINGE MECHANISM

(75) Inventors: Yan-Ming Hong, Hsinchu (TW); Po-Chun Huang, Taichung (TW); Cheng-Han Sung, Taichung (TW); Chih-Wei Chen, Miaoli County (TW)

(73) Assignee: INPAQ TECHNOLOGY CO., LTD., Hsinchu (TW)

( * ) Notice: Subject to any disclaimer, the term of this patent is extended or adjusted under 35 U.S.C. 154(b) by 392 days.

(21) Appl. No.: 13/547,112

(22) Filed: Jul. 12, 2012

(65) Prior Publication Data

US 2014/0015714 A1 Jan. 16, 2014

(51) Int. Cl.
*H01Q 1/22* (2006.01)
*H01Q 7/00* (2006.01)

(52) U.S. Cl.
CPC ..... *H01Q 1/2266* (2013.01); *H01Q 7/00* (2013.01)

(58) Field of Classification Search
CPC ..... H01Q 1/2266
USPC ..... 343/700 MS, 702
See application file for complete search history.

(56) References Cited

U.S. PATENT DOCUMENTS 6,864,841 B2 * 3/2005 Dai et al. ..... 343/700 MS
8,325,096 B2 * 12/2012 Vazquez et al. ..... 343/702
8,694,063 B2 * 4/2014 Hung et al. ..... 455/575.7

* cited by examiner

*Primary Examiner* — Robert Karacsony
(74) *Attorney, Agent, or Firm* — Li & Cai Intellectual Property (USA) Office

(57) ABSTRACT

A portable electronic device includes a casing unit, a first support unit, a second support unit, a first antenna unit, a second antenna unit, a first conducting unit and a second conducting unit. The casing unit includes a first outer casing and a second outer casing pivotally connected with the first outer casing. The first outer casing includes a hinge structure pivotally connected with the second outer casing. The first support unit includes a first support body disposed in the hinge structure, and the second support unit includes a second support body disposed in the hinge structure. The first antenna unit includes a first antenna structure disposed on the first support body and separated from the second outer casing. The second antenna unit includes a second antenna structure disposed on the second support body and separated from the second outer casing.

18 Claims, 8 Drawing Sheets

PORTABLE ELECTRONIC DEVICE AND HINGE MECHANISM

BACKGROUND OF THE INVENTION

1. Field of the Invention

The instant disclosure relates to a portable electronic device and a hinge mechanism, and more particularly, to a portable electronic device and a hinge mechanism having embedded antennas.

2. Description of Related Art

With the development of wireless communication technology, recently, the wireless communication technology has been widely applied in various fields, such as video program, wireless communication, and satellite positioning. In order to cater to the requirement of the electronic device, the signal transceiver circuit is reduced gradually, and is integrated in the electronic device, so as to improve the using convenience. However, with the requirement that the wireless communication functions (e.g. mobile communication function, global satellite positioning function, wireless network function, or digital broadcasting function etc.) of the electronic device become increasingly diversified, after each signal transceiver circuit is integrated into the electronic device, it is necessary for the manufacturers of the electronic device to dispose the respective antenna in the residual space of the electronic device. The antenna is one of the important elements affecting the quality of the wireless communication, so when the volume of the electronic device increasingly develops a design trend of being short, small, light, and thin, for the manufacturers of the electronic device, it is a problem to be solved by researcher how to integrate the antenna of various signal transceiver circuits in the electronic device.

SUMMARY OF THE INVENTION

One aspect of the instant disclosure relates to a portable electronic device and a hinge mechanism having embedded antennas for providing an optimum antenna efficiency.

One of the embodiments of the instant disclosure provides a portable electronic device, comprising: a casing unit, a first support unit, a second support unit, a first antenna unit, a second antenna unit, a first conducting unit and a second conducting unit. The casing unit includes at least one first outer casing and at least one second outer casing corresponding to the at least one first outer casing and pivotally connected with the at least one first outer casing, wherein the at least one first outer casing includes at least one hinge structure pivotally connected with the at least one second outer casing, and the at least one second outer casing has at least one groove for receiving the at least one hinge structure. The first support unit includes at least one first support body disposed in the at least one hinge structure. The second support unit includes at least one second support body disposed in the at least one hinge structure and separated from the at least one first support body by a predetermined distance. The first antenna unit includes at least one first antenna structure disposed on the at least one first support body and separated from the at least one second outer casing by a predetermined distance. The second antenna unit includes at least one second antenna structure disposed on the at least one second support body and separated from the at least one second outer casing by a predetermined distance. The first conducting unit includes at least one first conducting wire electrically connected to the at least one first antenna structure. The second conducting unit includes at least one second conducting wire electrically connected to the at least one second antenna structure.

Another one of the embodiments of the instant disclosure provides a hinge mechanism, comprising: a hinge unit, a first support unit, a second support unit, a first antenna unit, a second antenna unit, a first conducting unit and a second conducting unit. The hinge unit includes at least one hinge structure pivotally connected between at least one first outer casing and at least one second outer casing. The first support unit includes at least one first support body disposed in the at least one hinge structure. The second support unit includes at least one second support body disposed in the at least one hinge structure and separated from the at least one first support body by a predetermined distance. The first antenna unit includes at least one first antenna structure disposed on the at least one first support body and separated from the at least one second outer casing by a predetermined distance. The second antenna unit includes at least one second antenna structure disposed on the at least one second support body and separated from the at least one second outer casing by a predetermined distance. The first conducting unit includes at least one first conducting wire electrically connected to the at least one first antenna structure. The second conducting unit includes at least one second conducting wire electrically connected to the at least one second antenna structure.

More precisely, the at least one hinge structure has a receiving space formed therein, the at least one first support body and the at least one second support body are received in the receiving space of the at least one hinge structure, and the at least one first antenna structure and the at least one second antenna structure are received in the receiving space of the at least one hinge structure.

More precisely, the at least one hinge structure has at least two receiving spaces formed therein and communicated with each other, the at least one first support body and the at least one second support body are respectively received in the at least two receiving spaces of the at least one hinge structure, and the at least one first antenna structure and the at least one second antenna structure are respectively received in the at least two receiving spaces of the at least one hinge structure.

More precisely, the at least one hinge structure has at least two receiving spaces formed therein and isolated from each other, the at least one first support body and the at least one second support body are respectively received in the at least two receiving spaces of the at least one hinge structure, and the at least one first antenna structure and the at least one second antenna structure are respectively received in the at least two receiving spaces of the at least one hinge structure.

More precisely, the first support unit includes at least one hooking structure disposed on a lateral side of the at least one first support body and far away from the at least one second support body, and both the at least one first conducting wire and the at least one second conducting wire pass through the at least one hooking structure.

More precisely, the at least one first antenna structure is a loop antenna, and the at least one second antenna structure is a planar inverted-F antenna.

More precisely, the at least one first conducting wire includes a first inner conducting layer, a first inner insulating layer wrapping around the first inner conducting layer, a first outer conducting layer wrapping around the first inner insulating layer, and a first outer insulating layer wrapping around the first outer conducting layer.

More precisely, the at least one first antenna structure has a grounding portion neighboring to the at least one first outer casing, a first extending portion extended from an end side of the grounding portion and toward the at least one second outer casing, a second extending portion extended from the first extending portion and parallel to the grounding portion, a first ending portion extended from the second extending portion and toward the at least one first outer casing, and a second ending portion extended from another end side of the grounding portion and toward the at least one second outer casing and neighboring the first ending portion, and the first inner conducting layer and the first outer conducting layer of the at least one first conducting wire are respectively electrically contacted with the first ending portion and the second ending portion of the at least one first antenna structure.

More precisely, the at least one second conducting wire includes a second inner conducting layer, a second inner insulating layer wrapping around the second inner conducting layer, a second outer conducting layer wrapping around the second inner insulating layer, and a second outer insulating layer wrapping around the second outer conducting layer.

More precisely, the at least one second antenna structure has a grounding portion neighboring to the at least one first outer casing, a first extending portion extended from an end side of the grounding portion and toward the at least one second outer casing, a second extending portion extended from the first extending portion and parallel to the grounding portion, and the second inner conducting layer and the second outer conducting layer of the at least one second conducting wire are respectively electrically contacted with the second extending portion and the grounding portion of the at least one second antenna structure.

Therefore, both the portable electronic device and the hinge mechanism of the instant disclosure can provide an optimum antenna efficiency due to the design of the at least one first antenna structure disposed on the at least one first support body and separated from the at least one second outer casing by a predetermined distance and the at least one second antenna structure disposed on the at least one second support body and separated from the at least one second outer casing by a predetermined distance.

To further understand the techniques, means and effects of the instant disclosure applied for achieving the prescribed objectives, the following detailed descriptions and appended drawings are hereby referred, such that, through which, the purposes, features and aspects of the instant disclosure can be thoroughly and concretely appreciated. However, the appended drawings are provided solely for reference and illustration, without any intention to limit the instant disclosure.

DETAILED DESCRIPTION OF THE PREFERRED EMBODIMENTS

[First Embodiment]

Figure 1:
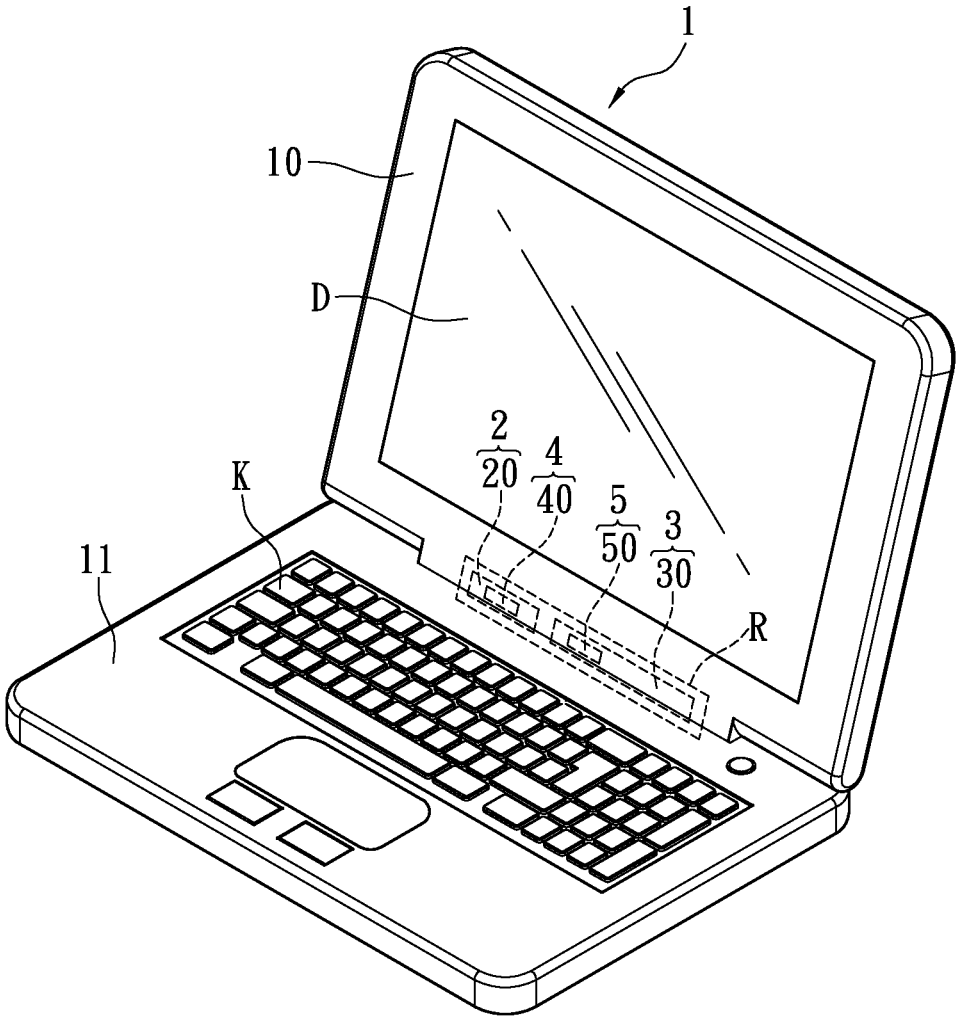
FIG. 1 shows a perspective, assembled, schematic view of the first outer casing and the second outer casing according to the first embodiment of the instant disclosure.

Referring to FIG. 1 to FIG. 6, where the first embodiment of the instant disclosure provides a portable electronic device, comprising: a casing unit 1, a first support unit 2, a second support unit 3, a first antenna unit 4, a second antenna unit 5, a first conducting unit 6 and a second conducting unit 7.

Figure 2:
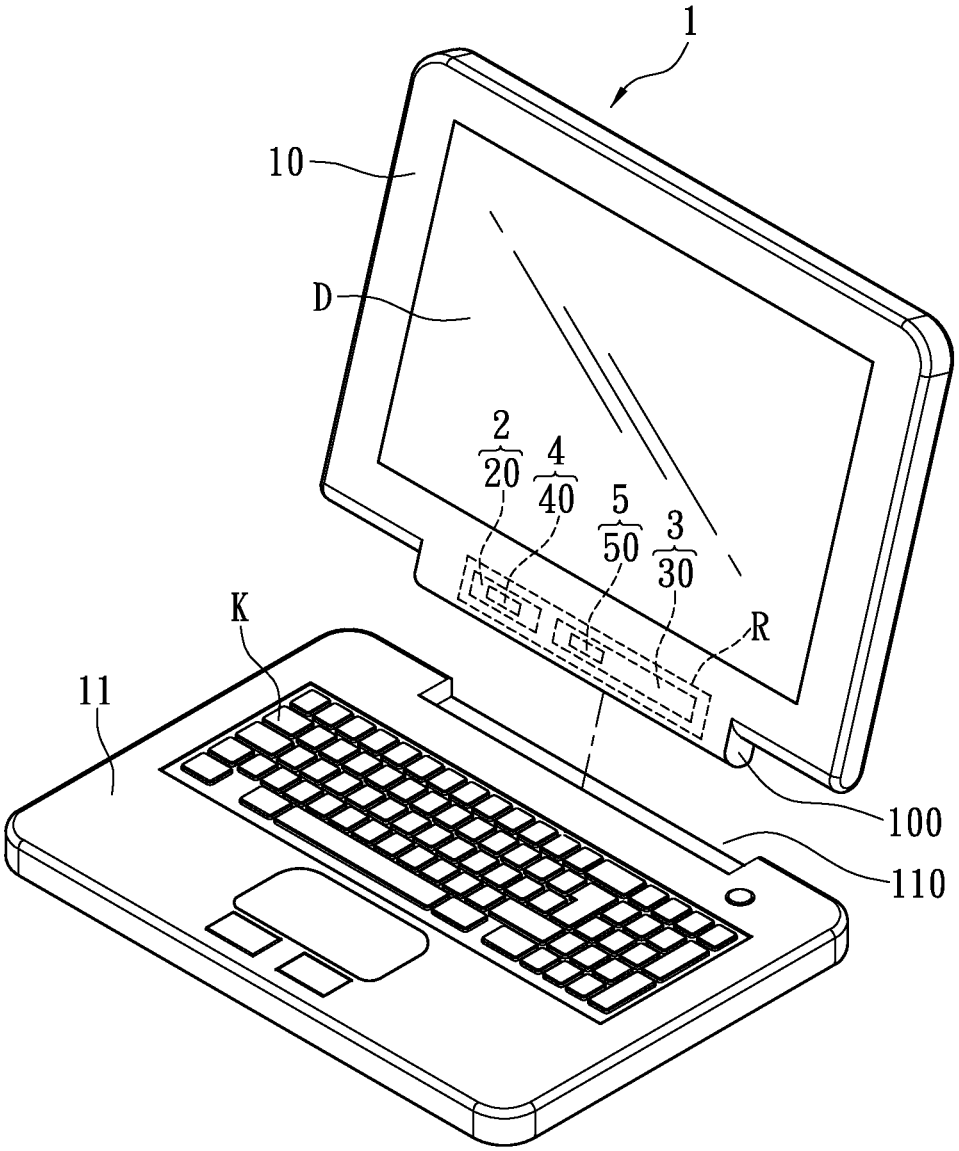
FIG. 2 shows a perspective, exploded, schematic view of the first outer casing and the second outer casing according to the first embodiment of the instant disclosure.
Figure 3A:
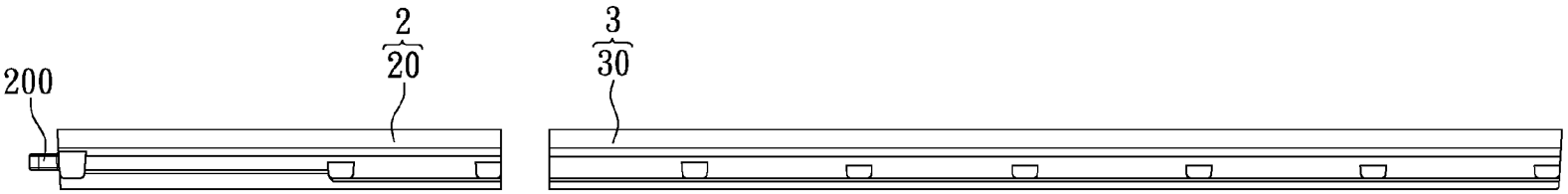
FIG. 3A shows a top, schematic view of the first support unit and the second support unit according to the first embodiment of the instant disclosure.
Figure 3B:
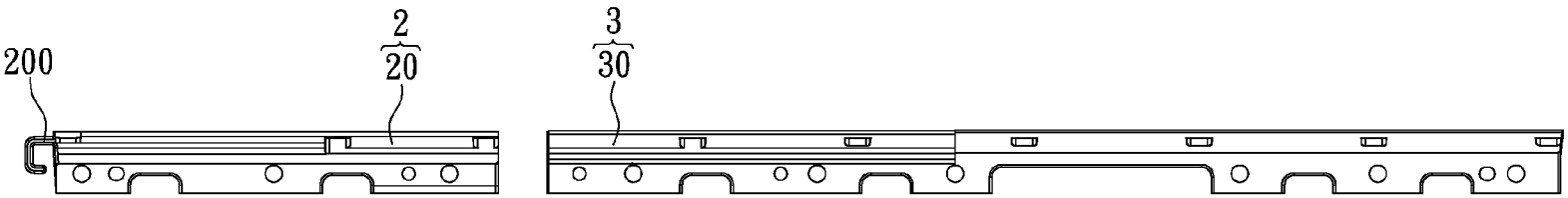
FIG. 3B shows a front, schematic view of the first support unit and the second support unit according to the first embodiment of the instant disclosure.
Figure 3C:
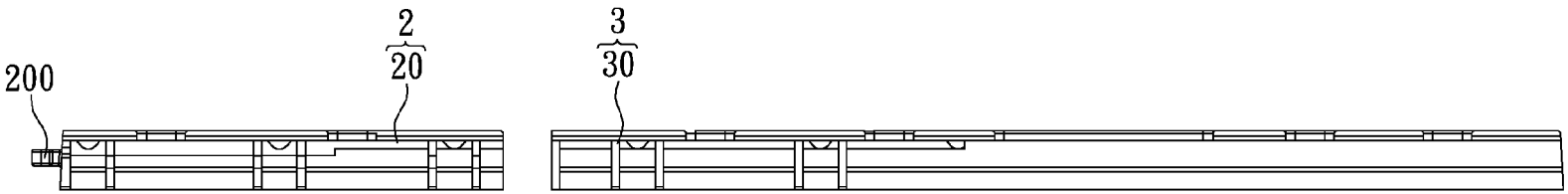
FIG. 3C shows a bottom, schematic view of the first support unit and the second support unit according to the first embodiment of the instant disclosure.

Referring to FIG. 1 and FIG. 2, the casing unit 1 includes at least one first outer casing 10 and at least one second outer casing 11 corresponding to the first outer casing 10 and pivotally connected with the first outer casing 10, where the first outer casing 10 includes at least one hinge structure 100 pivotally connected with the second outer casing 11, and the second outer casing 11 has at least one groove 110 for receiving the hinge structure 100. Moreover, the first support unit 2 includes at least one first support body 20 disposed in the hinge structure 100, and the second support unit 3 includes at least one second support body 30 disposed in the hinge structure 100 and separated from the first support body 20 by a predetermined distance. In addition, the first antenna unit 4 includes at least one first antenna structure 40 disposed on the first support body 20 and separated from the second outer casing 11 by a predetermined distance, and the second antenna unit 5 includes at least one second antenna structure 50 disposed on the second support body 30 and separated from the second outer casing 11 by a predetermined distance.

First, for example, referring to FIG. 1 and FIG. 2, the first outer casing 10 may be a bottom outer casing for holding a keyboard module K of the notebook, and the second outer casing 11 may be a top outer casing for holding a display screen D of the notebook. In addition, the hinge structure 100 has a receiving space R formed therein, the first support body 20 and the second support body 30 can be received in the receiving space R of the hinge structure 100, and the first antenna structure 40 and the second antenna structure 50 can be received in the receiving space R of the hinge structure 100. However, the above-mentioned design for the first outer casing 10 and the second outer casing 11 of the first embodiment is merely an example and is not meant to limit the instant disclosure.

Figure 4:
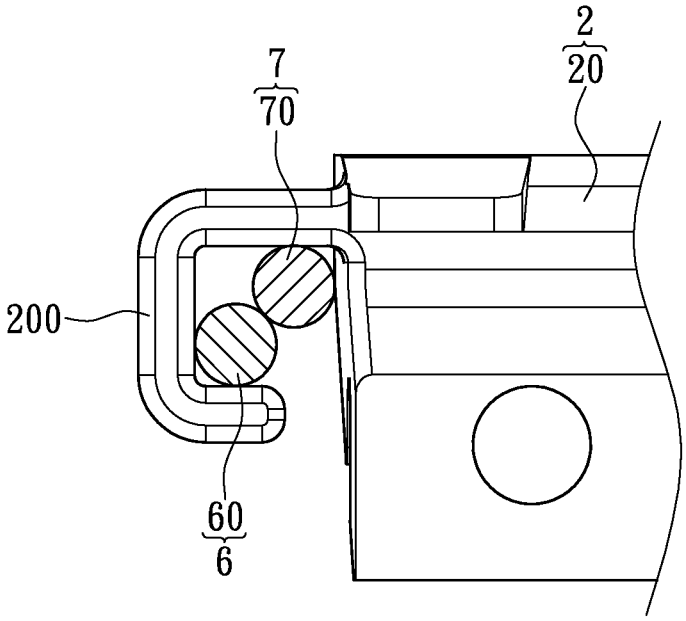
FIG. 4 shows a schematic view of the first conducting wire and the second conducting wire hooked by the hooking structure of the first support body according to the first embodiment of the instant disclosure.

Moreover, for example, referring to FIG. 2, FIGS. 3A to 3C, and FIG. 4, the first support unit 2 includes at least one hooking structure 200 disposed on a lateral side of the first support body 20 and far away from the second support body 30, and both the first conducting wire 60 of the first conducting unit 6 and the second conducting wire 70 of the second conducting unit 7 pass through the hooking structure 200. In other words, after the first conducting wire 60 and the second conducting wire 70 are respectively electrically connected to the first antenna structure 40 and the second antenna structure 50, both the first conducting wire 60 and the second conducting wire 70 can concurrently pass through the hooking structure 200 (as shown in FIG. 4), thus both the first conducting wire 60 and the second conducting wire 70 can concurrently retained by the hooking structure 200. However, the above-mentioned design for the hooking structure 200 of the first support body 20 of the first embodiment is merely an example and is not meant to limit the instant disclosure.

Figure 5:
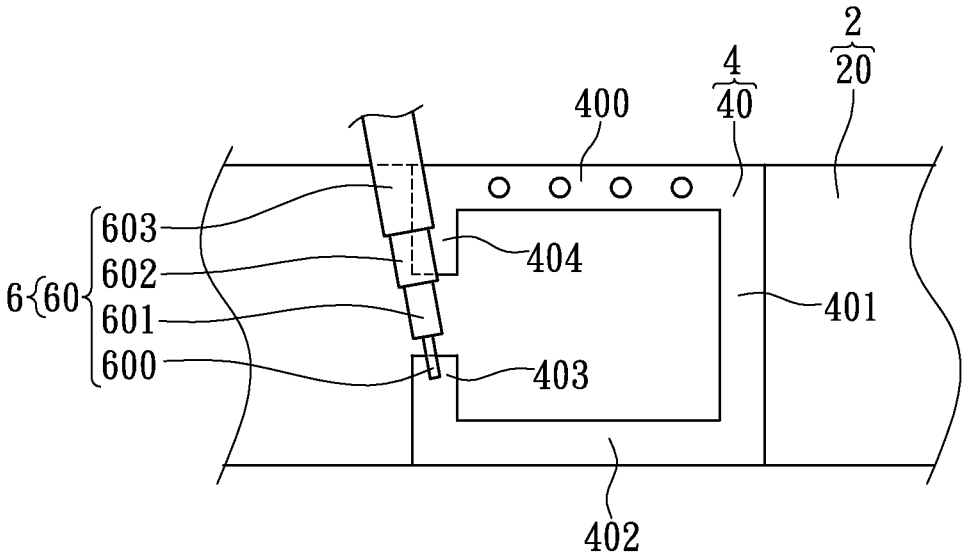
FIG. 5 shows a schematic view of the first antenna unit disposed on the first support unit according to the first embodiment of the instant disclosure.

Furthermore, for example, referring to FIG. 2 and FIG. 5, the first antenna structure 40 may be a loop antenna. The first antenna structure 40 has a grounding portion 400 neighboring to the first outer casing 10, a first extending portion 401 extended from an end side of the grounding portion 400 and toward the second outer casing 11, a second extending portion 402 extended from the first extending portion 401 and substantially parallel to the grounding portion 400, a first ending portion 403 extended from the second extending portion 402 and toward the first outer casing 10, and a second ending portion 404 extended from another end side of the grounding portion 400 and toward the second outer casing 11 and neighboring the first ending portion 403. In addition, the first conducting unit 6 includes at least one first conducting wire 60 electrically connected to the first antenna structure 40. The first conducting wire 60 includes a first inner conducting layer 600, a first inner insulating layer 601 wrapping around (formed annularly around) the first inner conducting layer 600, a first outer conducting layer 602 wrapping around the first inner insulating layer 601, and a first outer insulating layer 603 wrapping around the first outer conducting layer 602, and the first inner conducting layer 600 and the first outer conducting layer 602 of the first conducting wire 60 can be respectively electrically contacted with the first ending portion 403 and the second ending portion 404 (or the grounding portion 400) of the first antenna structure 40. However, the above-mentioned design for the first antenna structure 40 and the first conducting wire 60 of the first embodiment is merely an example and is not meant to limit the instant disclosure.

Figure 6:
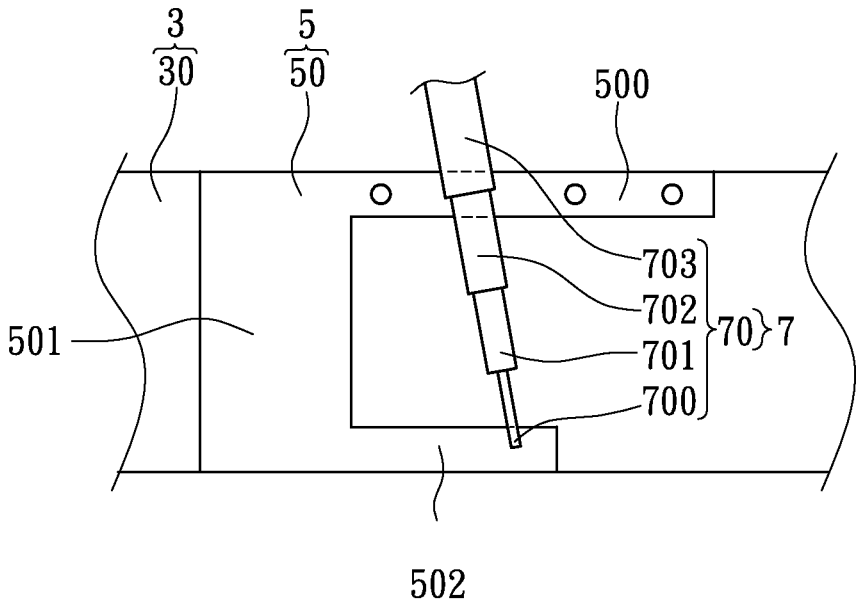
FIG. 6 shows a schematic view of the second antenna unit disposed on the second support unit according to the first embodiment of the instant disclosure.

Besides, referring to FIG. 2 and FIG. 6, the second antenna structure 50 may be a planar inverted-F antenna. The second antenna structure 50 has a grounding portion 500 neighboring to the first outer casing 10, a first extending portion 501 extended from an end side of the grounding portion 500 and toward the second outer casing 11, a second extending portion 502 extended from the first extending portion 501 and substantially parallel to the grounding portion 500. In addition, the second conducting unit 7 includes at least one second conducting wire 70 electrically connected to the second antenna structure 50. The second conducting wire 70 includes a second inner conducting layer 700, a second inner insulating layer 701 wrapping around the second inner conducting layer 700, a second outer conducting layer 702 wrapping around the second inner insulating layer 701, and a second outer insulating layer 703 wrapping around the second outer conducting layer 702, and the second inner conducting layer 700 and the second outer conducting layer 702 of the second conducting wire 70 can be respectively electrically contacted with the second extending portion 502 and the grounding portion 500 of the second antenna structure 50. However, the above-mentioned design for the second antenna structure 50 and the second conducting wire 70 of the first embodiment is merely an example and is not meant to limit the instant disclosure.

Figure 7A:
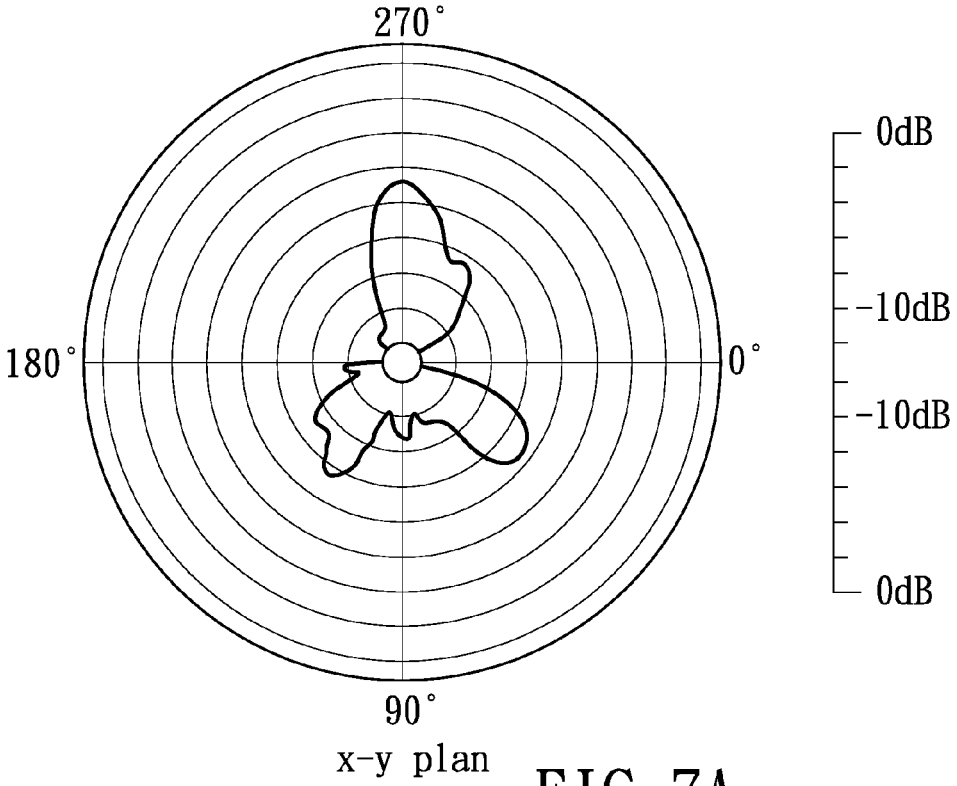
FIG. 7A shows an E-total radiation pattern of the first antenna structure on X-Y plane according to the first embodiment of the instant disclosure.
Figure 7B:
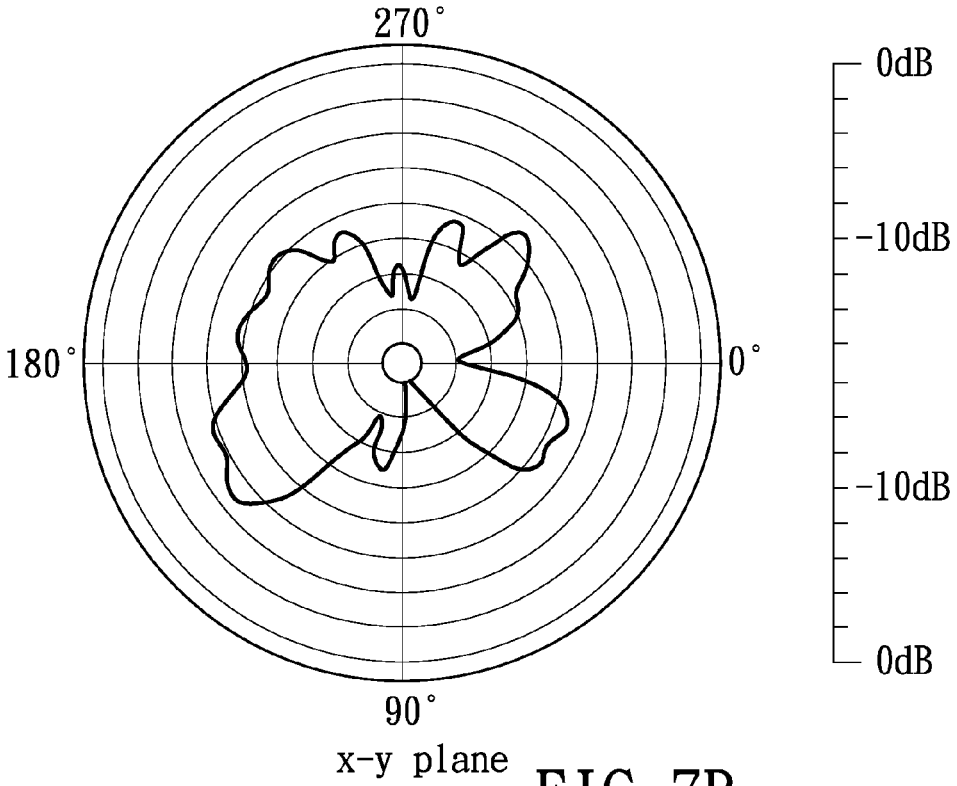
FIG. 7B shows an E-total radiation pattern of the second antenna structure on X-Y plane according to the first embodiment of the instant disclosure.
Figure 8A:
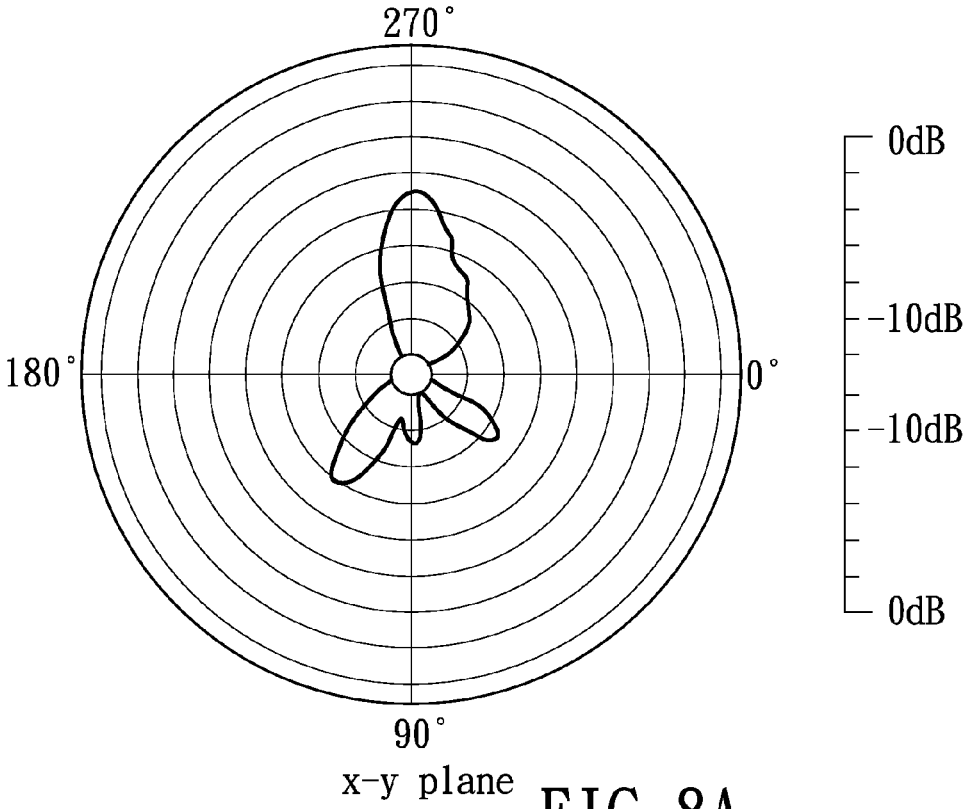
FIG. 8A shows an E-theta radiation pattern of the first antenna structure on X-Y plane according to the first embodiment of the instant disclosure.
Figure 8B:
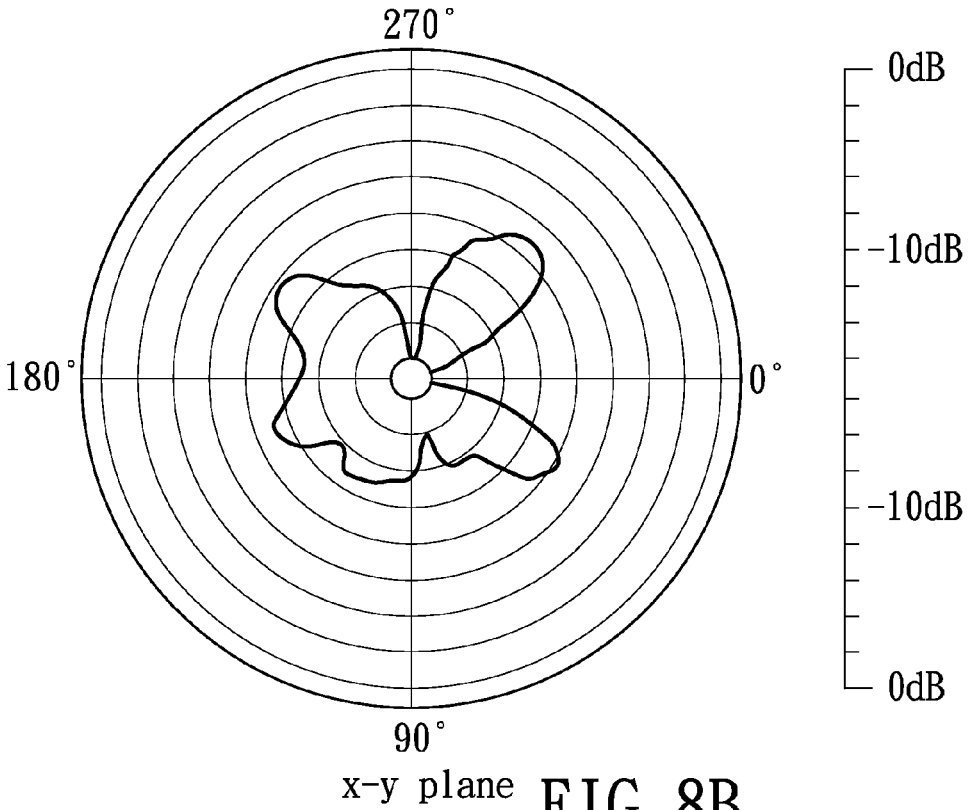
FIG. 8B shows an E-theta radiation pattern of the second antenna structure on X-Y plane according to the first embodiment of the instant disclosure.

Referring to FIG. 7A to FIG. 8B, where FIG. 7A and FIG. 8A respectively show an E-total radiation pattern and an E-theta radiation pattern of the first antenna structure 40 on X-Y plane, and FIG. 7B and FIG. 8B respectively show an E-total radiation pattern and an E-theta radiation pattern of the second antenna structure 50 on X-Y plane. When the first antenna structure 40 and the second antenna structure 50 are mated with each other, the instant disclosure can obtain a radiation pattern similar to an omni-directional radiation pattern, thus the portable electronic device can provide an optimum antenna efficiency due to the match of the first antenna structure 40 and the second antenna structure 50.

Furthermore, the first embodiment of the instant disclosure also provides a hinge mechanism, comprising: a hinge unit, a first support unit 2, a second support unit 3, a first antenna unit 4, a second antenna unit 5, a first conducting unit 6 and a second conducting unit 7. The hinge unit includes at least one hinge structure 100 pivotally connected between at least one first outer casing 10 and at least one second outer casing 11. In addition, the first support unit 2 includes at least one first support body 20 disposed in the hinge structure 100, and the second support unit 3 includes at least one second support body 30 disposed in the hinge structure 100 and separated from the first support body 20 by a predetermined distance. Moreover, the first antenna unit 4 includes at least one first antenna structure 40 disposed on the first support body 20 and separated from the second outer casing 11 by a predetermined distance, and the second antenna unit 5 includes at least one second antenna structure 50 disposed on the second support body 30 and separated from the second outer casing 11 by a predetermined distance. Furthermore, the first conducting unit 6 includes at least one first conducting wire 60 electrically connected to the first antenna structure 40, and the second conducting unit 7 includes at least one second conducting wire 70 electrically connected to the second antenna structure 50.

[Second Embodiment]

Figure 9:
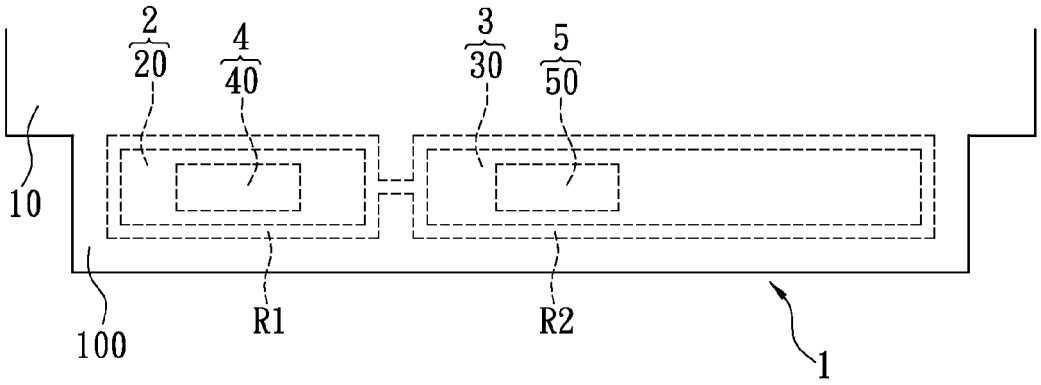
FIG. 9 shows a schematic view of the first antenna structure and the second antenna structure respectively received in the two different receiving spaces according to the second embodiment of the instant disclosure.

Referring to FIG. 9, the second embodiment of the instant disclosure provides a portable electronic device. Comparing FIG. 9 with FIG. 2, the difference between the second embodiment and the first embodiment is as follows: in the second embodiment, the hinge structure 100 has at least two receiving spaces (R1, R2) formed therein and communicated with each other, the first support body 20 and the second support body 30 can be respectively received in the at least two receiving spaces (R1, R2) of the hinge structure 100, and the first antenna structure 20 and the second antenna structure 30 can be respectively received in the at least two receiving spaces (R1, R2) of the hinge structure 100.

[Third Embodiment]

Figure 10:
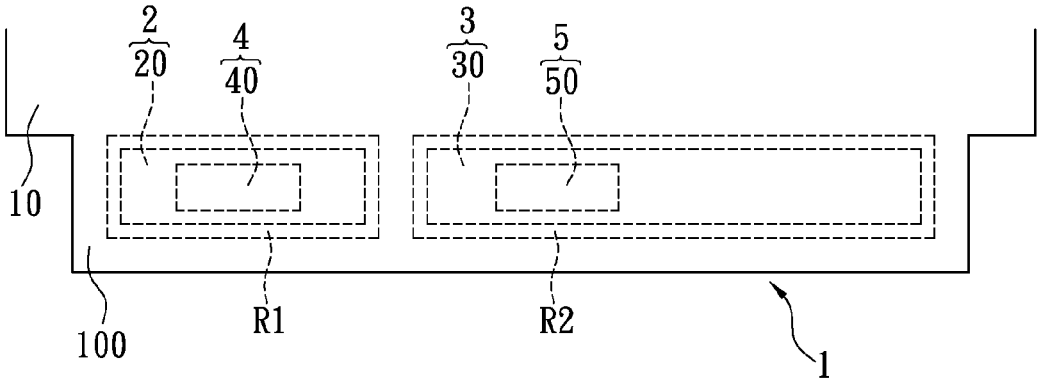
FIG. 10 shows a schematic view of the first antenna structure and the second antenna structure respectively received in the two different receiving spaces according to the third embodiment of the instant disclosure.

Referring to FIG. 10, the third embodiment of the instant disclosure provides a portable electronic device. Comparing FIG. 10 with FIG. 2, the difference between the third embodiment and the first embodiment is as follows: in the third embodiment, the hinge structure 100 has at least two receiving spaces (R1, R2) formed therein and isolated from each other, the first support body 20 and the second support body 30 can be respectively received in the at least two receiving spaces (R1, R2) of the hinge structure 100, and the first antenna structure 40 and the second antenna structure 50 can be respectively received in the at least two receiving spaces (R1, R2) of the hinge structure 100.

In conclusion, both the portable electronic device and the hinge mechanism of the instant disclosure can provide optimum antenna efficiency due to the design of the first antenna structure disposed on the first support body and separated from the second outer casing by a predetermined distance and the second antenna structure disposed on the second support body and separated from the second outer casing by a predetermined distance.

The above-mentioned descriptions merely represent the preferred embodiments of the instant disclosure, without any intention or ability to limit the scope of the instant disclosure which is fully described only within the following claims Various equivalent changes, alterations or modifications based on the claims of instant disclosure are all, consequently, viewed as being embraced by the scope of the instant disclosure.

What is claimed is:

1. A portable electronic device, comprising:

a casing unit including at least one first outer casing and at least one second outer casing corresponding to the at least one first outer casing and pivotally connected with the at least one first outer casing, wherein the at least one first outer casing includes at least one hinge structure pivotally connected with the at least one second outer casing, and the at least one second outer casing has at least one groove for receiving the at least one hinge structure;

a first support unit including at least one first support body disposed in the at least one hinge structure;

a second support unit including at least one second support body disposed in the at least one hinge structure and separated from the at least one first support body by a predetermined distance;

a first antenna unit including at least one first antenna structure disposed on the at least one first support body and separated from the at least one second outer casing by a predetermined distance;

a second antenna unit including at least one second antenna structure disposed on the at least one second support body and separated from the at least one second outer casing by a predetermined distance;

a first conducting unit including at least one first conducting wire electrically connected to the at least one first antenna structure; and a second conducting unit including at least one second conducting wire electrically connected to the at least one second antenna structure;

wherein the first support unit includes at least one hooking structure disposed on a lateral side of the at least one first support body and far away from the at least one second support body, and both the at least one first conducting wire and the at least one second conducting wire pass through the at least one hooking structure.

2. The portable electronic device of claim 1, wherein the at least one hinge structure has a receiving space formed therein, the at least one first support body and the at least one second support body are received in the receiving space of the at least one hinge structure, and the at least one first antenna structure and the at least one second antenna structure are received in the receiving space of the at least one hinge structure.

3. The portable electronic device of claim 1, wherein the at least one hinge structure has at least two receiving spaces formed therein and communicated with each other, the at least one first support body and the at least one second support body are respectively received in the at least two receiving spaces of the at least one hinge structure, and the at least one first antenna structure and the at least one second antenna structure are respectively received in the at least two receiving spaces of the at least one hinge structure.

4. The portable electronic device of claim 1, wherein the at least one hinge structure has at least two receiving spaces formed therein and isolated from each other, the at least one first support body and the at least one second support body are respectively received in the at least two receiving spaces of the at least one hinge structure, and the at least one first antenna structure and the at least one second antenna structure are respectively received in the at least two receiving spaces of the at least one hinge structure.

5. The portable electronic device of claim 1, wherein the at least one first antenna structure is a loop antenna, and the at least one second antenna structure is a planar inverted-F antenna.

6. The portable electronic device of claim 1, wherein the at least one first conducting wire includes a first inner conducting layer, a first inner insulating layer wrapping around the first inner conducting layer, a first outer conducting layer wrapping around the first inner insulating layer, and a first outer insulating layer wrapping around the first outer conducting layer.

7. The portable electronic device of claim 6, wherein the at least one first antenna structure has a grounding portion neighboring to the at least one first outer casing, a first extending portion extended from an end side of the grounding portion and toward the at least one second outer casing, a second extending portion extended from the first extending portion and parallel to the grounding portion, a first ending portion extended from the second extending portion and toward the at least one first outer casing, and a second ending portion extended from another end side of the grounding portion and toward the at least one second outer casing and neighboring the first ending portion, and the first inner conducting layer and the first outer conducting layer of the at least one first conducting wire are respectively electrically contacted with the first ending portion and the second ending portion of the at least one first antenna structure.

8. The portable electronic device of claim 1, wherein the at least one second conducting wire includes a second inner conducting layer, a second inner insulating layer wrapping around the second inner conducting layer, a second outer conducting layer wrapping around the second inner insulating layer, and a second outer insulating layer wrapping around the second outer conducting layer.

9. The portable electronic device of claim 8, wherein the at least one second antenna structure has a grounding portion neighboring to the at least one first outer casing, a first extending portion extended from an end side of the grounding portion and toward the at least one second outer casing, a second extending portion extended from the first extending portion and parallel to the grounding portion, and the second inner conducting layer and the second outer conducting layer of the at least one second conducting wire are respectively electrically contacted with the second extending portion and the grounding portion of the at least one second antenna structure.

10. A hinge mechanism, comprising:

a hinge unit including at least one hinge structure pivotally connected between at least one first outer casing and at least one second outer casing;

a first support unit including at least one first support body disposed in the at least one hinge structure;

a second support unit including at least one second support body disposed in the at least one hinge structure and separated from the at least one first support body by a predetermined distance;

a first antenna unit including at least one first antenna structure disposed on the at least one first support body and separated from the at least one second outer casing by a predetermined distance;

a second antenna unit including at least one second antenna structure disposed on the at least one second support body and separated from the at least one second outer casing by a predetermined distance;

a first conducting unit including at least one first conducting wire electrically connected to the at least one first antenna structure; and a second conducting unit including at least one second conducting wire electrically connected to the at least one second antenna structure;

wherein the first support unit includes at least one hooking structure disposed on a lateral side of the at least one first support body and far away from the at least one second support body, and both the at least one first conducting wire and the at least one second conducting wire pass through the at least one hooking structure.

11. The hinge mechanism of claim 10, wherein the at least one hinge structure has a receiving space formed therein, the at least one first support body and the at least one second support body are received in the receiving space of the at least one hinge structure, and the at least one first antenna structure and the at least one second antenna structure are received in the receiving space of the at least one hinge structure.

12. The hinge mechanism of claim 10, wherein the at least one hinge structure has at least two receiving spaces formed therein and communicated with each other, the at least one first support body and the at least one second support body are respectively received in the at least two receiving spaces of the at least one hinge structure, and the at least one first antenna structure and the at least one second antenna structure are respectively received in the at least two receiving spaces of the at least one hinge structure.

13. The hinge mechanism of claim 10, wherein the at least one hinge structure has at least two receiving spaces formed therein and isolated from each other, the at least one first support body and the at least one second support body are respectively received in the at least two receiving spaces of the at least one hinge structure, and the at least one first antenna structure and the at least one second antenna structure are respectively received in the at least two receiving spaces of the at least one hinge structure.

14. The hinge mechanism of claim 10, wherein the at least one first antenna structure is a loop antenna, and the at least one second antenna structure is a planar inverted-F antenna.

15. The hinge mechanism of claim 10, wherein the at least one first conducting wire includes a first inner conducting layer, a first inner insulating layer wrapping around the first inner conducting layer, a first outer conducting layer wrapping around the first inner insulating layer, and a first outer insulating layer wrapping around the first outer conducting layer.

16. The hinge mechanism of claim 15, wherein the at least one first antenna structure has a grounding portion neighboring to the at least one first outer casing, a first extending portion extended from an end side of the grounding portion and toward the at least one second outer casing, a second extending portion extended from the first extending portion and parallel to the grounding portion, a first ending portion extended from the second extending portion and toward the at least one first outer casing, and a second ending portion extended from another end side of the grounding portion and toward the at least one second outer casing and neighboring the first ending portion, and the first inner conducting layer and the first outer conducting layer of the at least one first conducting wire are respectively electrically contacted with the first ending portion and the second ending portion of the at least one first antenna structure.

17. The hinge mechanism of claim 10, wherein the at least one second conducting wire includes a second inner conducting layer, a second inner insulating layer wrapping around the second inner conducting layer, a second outer conducting layer wrapping around the second inner insulating layer, and a second outer insulating layer wrapping around the second outer conducting layer.

18. The hinge mechanism of claim 17, wherein the at least one second antenna structure has a grounding portion neighboring to the at least one first outer casing, a first extending portion extended from an end side of the grounding portion and toward the at least one second outer casing, a second extending portion extended from the first extending portion and parallel to the grounding portion, and the second inner conducting layer and the second outer conducting layer of the at least one second conducting wire are respectively electrically contacted with the second extending portion and the grounding portion of the at least one second antenna structure.

* * * * *